United States Patent [19]

Kustas

[11] 4,367,138

[45] Jan. 4, 1983

[54] FLATWARE RECOVERY FOOD SCRAPER

[76] Inventor: John Kustas, 785 W. Sherman Ave., Vineland, N.J. 08360

[21] Appl. No.: 271,397

[22] Filed: Jun. 8, 1981

[51] Int. Cl.[3] ..... B03C 1/26

[52] U.S. Cl. ..... 209/224; 209/215; 209/223 R; 209/636; 209/926; 428/36

[58] Field of Search ..... 209/636, 926, 223 R, 209/223 A, 224, 216, 215; 428/36

[56] References Cited

U.S. PATENT DOCUMENTS

| | | | |
|---|---|---|---|
| 689,561 | 12/1901 | McKenna | 209/224 |
| 2,369,795 | 1/1959 | Higer | 241/81 |
| 2,992,735 | 7/1961 | Troy | 209/223 R |
| 3,926,762 | 12/1975 | Buford | 209/216 |
| 4,067,810 | 1/1978 | Sullivan | 209/224 |

*Primary Examiner*—William R. Dixon, Jr.
*Attorney, Agent, or Firm*—Duffield & Lehrer

[57] ABSTRACT

A substantially cylindrically shaped rubber food scraper is mounted on a steel dish cleaning table over a refuse container located below the table. The interior of the scraper is substantially hourglass shaped and includes a plurality of magnets embedded in the interior wall thereof adjacent the reduced diameter portion. Food and waste paper scraped from dishes pass through the scraper to the container below but stainless steel flatware is attracted to and held by the magnets.

5 Claims, 3 Drawing Figures

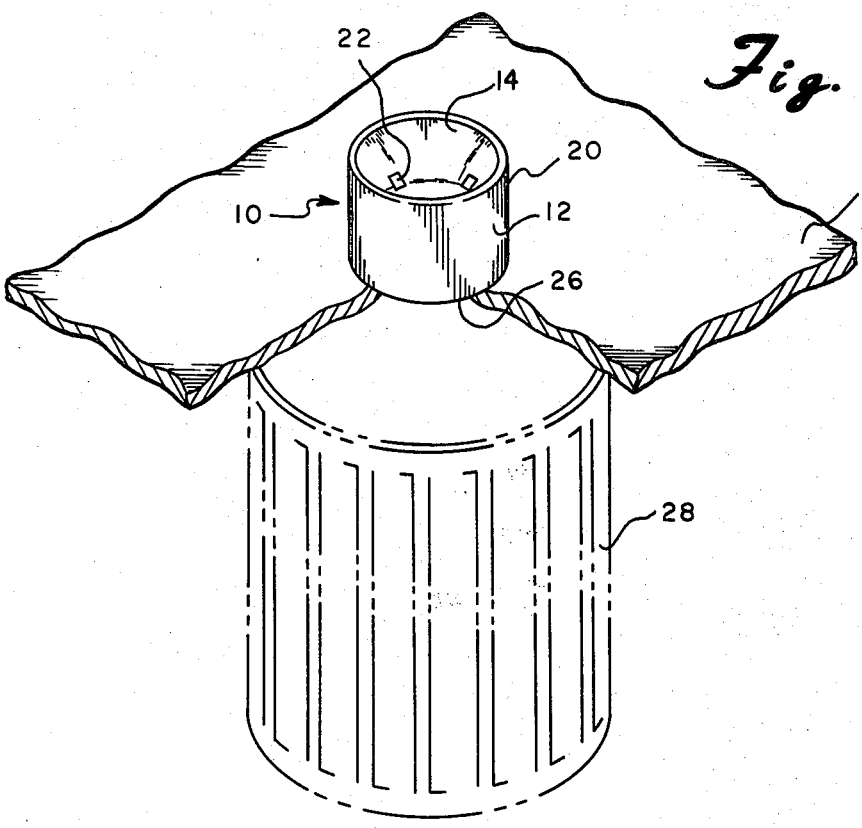
Fig. 1
Fig. 2
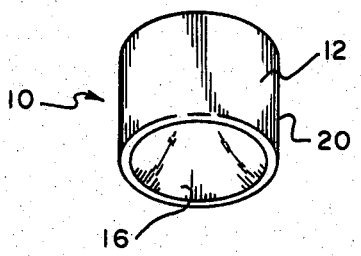
Fig. 3
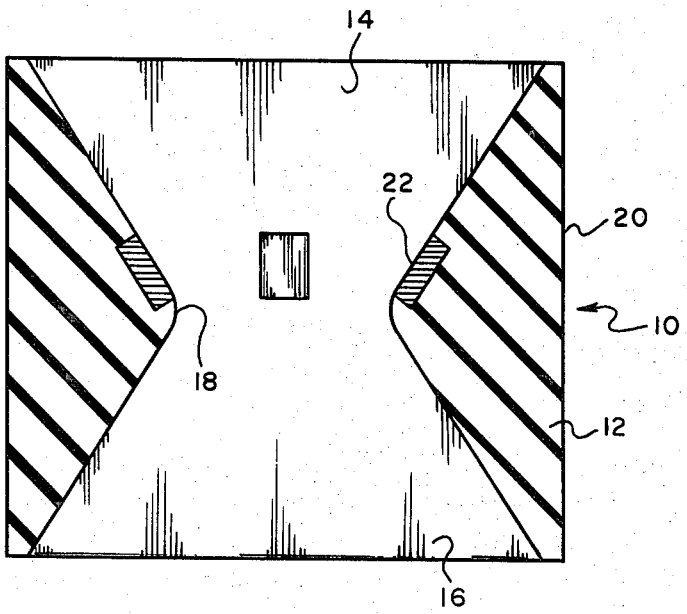

FLATWARE RECOVERY FOOD SCRAPER

BACKGROUND OF THE INVENTION

The present invention is directed toward a flatware recovery food scraper and more particularly toward such a food scraper which can replace conventional food scrapers but which includes magnet means for preventing the inadvertent loss of stainless steel flatware.

As is well-known in the restaurant business, the loss of silverware or stainless steel flatware is a very serious problem which costs restaurant owners large sums of money every year. The problem stems from careless kitchen help and the manner in which food and debris is removed from used dishes.

Many modern restaurant kitchens utilize stainless steel tables for rinsing dishes and moving them to the dishwasher, etc. Such tables conventionally carry a food scraper which is comprised of a hard rubber cylindrical member approximately five inches in diameter and five inches high. The scraper is mounted with its axis vertical over an opening in the stainless steel table which overlies a garbage can there below. In use, a plate with food or debris and the like is turned upside down over the food scraper and slid there across so that the food from the plate falls through the opening in the center of the food scraper. The upper wall of the scraper scrapes the plate. Any flatware which was on the plate and which may have been hidden under food or paper or other debris would fall through the center of the food scraper into the garbage can without the kitchen help knowing of the same.

Inventions have been proposed in an attempt to alleviate the problem of lost flatware. One such proposal is described in U.S. Pat. No. 3,926,792. This patent is directed toward a machine including a conveyer belt having magnetic means associated therewith. Trash and garbage and the like from dishes are placed on the conveyer belt and the same falls from the moving conveyer into a receptacle on the underside of the conveyer belt. The magnet means, however, retain the stainless steel flatware on the conveyer belt until released therefrom at a different position beneath the belt. This system, however, is relatively complex and would be prohibitively expensive for most restaurants. Furthermore, it would take up a great deal of space which is normally at a premium in a restaurant kitchen.

Magnets have also been used in similar environments for preventing the loss of stainless steel flatware. For example, U.S. Pat. No. 2,869,795 describes a device for preventing damage to a garbage disposal caused by silverware. The device includes a tray upon which is intended to be deposited a quantity of garbage. Batches of the garbage can then be pushed through an opening in the tray into the garbage disposal mounted below. A plurality of magnets mounted beneath the tray attract the silverware or other metal objects to prevent them from being pushed into the opening. While this device may have some usefulness, it is not easily adaptable to a stainless steel table such as described above as additional scraper means would be necessary.

SUMMARY OF THE INVENTION

The present invention is believed to eliminate or at least substantially reduce the loss of flatware in a very simple and inexpensive manner which is not capable of being accomplished with the devices described above.

With the present invention, a substantially cylindrically shaped rubber food scraper is mounted on a steel dish cleaning table over a refuse container located below the table. The interior of the scraper is substantially hourglass shaped and includes a plurality of magnets embedded in the interior wall thereof adjacent the reduced diameter portion. Food and waste paper scraped from dishes pass through the scraper to the container below but stainless steel flatware is attracted to and held by the magnets.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

FIG. 1 is a perspective view of a flatware recovery food scraper constructed in accordance with the principles of the present invention and shown in use on a stainless steel table, part of which has been broken away for clarity;

FIG. 2 is a bottom perspective view, and

FIG. 3 is a cross-sectional view showing a vertical section through the axis of the device.

DETAILED DESCRIPTION OF THE PREFERRED EMBODIMENT

Referring now to the drawing in detail wherein like reference numerals have been used throughout the various figures to designate like elements, there is shown in FIGS. 1, 2 and 3 a flatware recovery food scraper constructed in accordance with the principles of the present invention and designated generally as 10.

Food scraper 10 is comprised of a substantially tubular member 12 which, in the preferred embodiment, is circular in cross section. Tubular member 12 has a height of approximately five to six inches and an overall diameter of approximately five to six inches. This is, of course, by way of example only as other sizes could be utilized. Preferably, the tubular member 12 is comprised of a polymeric material such as a hard natural or synthetic rubber or the like.

Tubular member 12 has an opening 14 at the top or upper end thereof and a similar opening 16 at the bottom. As shown most clearly in FIG. 3, the interior of the tubular member 12 is substantially hourglass shaped. That is, the interior diameter gradually decreases from the opening 14 to a reduced diameter portion 18 and then increases again to the diameter of the bottom opening 16.

The outer wall 20 of the tubular member 12 is shown to be straight. Thus, the wall is relatively thin adjacent the openings and is at its thickest adjacent the reduced diameter portion 18. This again, however, is by way of example only. It is within the scope of the present invention that the exterior wall 12 be substantially any shape including an hourglass shape similar to the interior walls.

Embedded in the interior wall of the tubular member 12 are a plurality of magnets 22. As is best shown in FIG. 3, the magnets 22 are embedded in the wall so that the outer surface of the magnet is substantially flush with the wall of the interior surface. In this way, the interior surface is substantially continuous and smooth and food or other debris cannot get caught as it would if the magnet projected outwardly. It is also preferable to coat the exposed surface of the magnet with some material to prevent corrosion.

The magnets 22 are preferably mounted just above the reduced diameter portion 18. While four separate magnets are shown, it should be readily apparent that any number of magnets could be utilized. Clearly, the more area which is covered by magnets, the more likely that the silverware will be attracted thereby. The shape of the magnets may also be changed, as desired. For example, one or more ring-shaped magnets could be utilized.

The food scraper 10 of the present invention is utilized in substantially the same manner as a conventional food scraper. The food scraper 10 is mounted on a stainless steel table 24 which has an opening 26 therein in alignment with the openings 14 and 16 in the food scraper 10. A garbage can or refuse container 28 is located on the floor beneath the table 24. Food, paper and other similar debris from plates which are scraped across the top of the food scraper 10 fall through the food scraper into the container 28. Stainless steel flatware, however, is attracted to and held by the magnets 22.

The present invention may be embodied in other specific forms without departing from the spirit or essential attributes thereof and accordingly, reference should be made to the appended claims rather than to the foregoing specification as indicating the scope of the invention.

I claim:

1. A food scraper for preventing the loss of flatware in a restaurant comprising:

a tubular member of circular cross section having concentric openings at each end thereof and being constructed essentially of a polymeric material;

the interior wall of said member being substantially smooth and continuous;

the exterior wall of said member being substantially cylindrical;

a reduced diameter portion within the interior of said tubular member and intermediate the ends thereof, and magnet means embedded within the interior wall of said tubular member adjacent said reduced diameter portion.

2. The food scraper as claimed in claim 1 wherein said interior is substantially hourglass shaped.

3. The food scraper as claimed in claim 1 wherein said tubular member has an entrance end and a discharge end, the interior diameter of said member gradually decreasing from said entrance end to said reduced diameter portion.

4. The food scraper as claimed in claim 3 wherein the interior diameter of said member gradually increases from said reduced diameter portion to said discharge end.

5. The food scraper as claimed in claim 1 wherein said magnet means includes a plurality of magnets spaced around the interior of said tubular member.

* * * * *